US005337531A

United States Patent [19]

Thompson et al.

[11] Patent Number: 5,337,531

[45] Date of Patent: Aug. 16, 1994

[54] ADJUSTABLE CAMBER TRUSS

[75] Inventors: Sidney L. Thompson, Trussville; Claude D. Wilkerson, Birmingham, both of Ala.

[73] Assignee: Thompson Fabricating Company, Inc., Birmingham, Ala.

[21] Appl. No.: 959,923

[22] Filed: Oct. 15, 1992

[51] Int. Cl.[5] ..... E04B 1/32

[52] U.S. Cl. ..... 52/640; 52/223.8; 52/645

[58] Field of Search ..... 52/640, 639, 645, 641, 52/223.8, 223.11, 223.12, 223.14, 691

[56] References Cited

U.S. PATENT DOCUMENTS

| | | | |
|---|---|---|---|
| 1,112,542 | 10/1914 | Loser . | |
| 1,163,641 | 12/1915 | Cummings . | |
| 1,174,931 | 3/1916 | Furry . | |
| 2,793,720 | 5/1957 | Hawes . | |
| 2,984,944 | 5/1961 | Sapp | 52/639 |
| 2,985,264 | 5/1961 | Leonard, Jr. . | |
| 3,994,036 | 11/1976 | Fisher . | |
| 4,353,190 | 10/1982 | Gleeson | 52/641 |

FOREIGN PATENT DOCUMENTS

| | | | |
|---|---|---|---|
| 1481350 | 5/1989 | U.S.S.R. | 52/639 |

OTHER PUBLICATIONS

Two pages entitled "Trusses–A Study by the Historic American Enginnering Record".

Two pages including Table 2–3 and FIGS. 2–16 and 2–17 with a text section entitled "Prestressed Steel Trusses".

*Primary Examiner*—Carl D. Friedman
*Assistant Examiner*—Kien Nguyen
*Attorney, Agent, or Firm*—Finnegan, Henderson, Farabow, Garrett & Dunner

[57] ABSTRACT

An adjustable camber truss comprising an upper chord member having opposed ends and being disposed to receive a load acting in one direction; a major support structure fixed to and subtending substantially the entire length of the upper chord member, the major support structure including a major king post fixed to the upper chord member at a post position proximate the midpoint between the opposed ends and extending therefrom in the one direction to a distal end and a pair of major tension members, each major tension member having a first end fixed to the upper chord member proximate a respective one of the opposed ends thereof and an axially opposed second end slidably extending through one end of a tube fixed to the distal end of the major king post and threadably receiving a nut for selective adjustment against one end of the tube.

8 Claims, 4 Drawing Sheets

ADJUSTABLE CAMBER TRUSS

BACKGROUND OF THE INVENTION

1. Field of the Invention

The invention relates to structural trusses and in particular structural trusses in which the camber of the load bearing upper chord member may be selectively adjusted.

2. Description of the Related Art

Trusses are common structures for supporting a load. They are used most often to support roofs, bridges and other loads spanning relatively large distances.

For improved efficiency in bearing flexural and axially loads the trusses have been designed to permit prestressing the entire truss. Members of the truss that would be in tension under load are placed in compression by prestressing so that when the working load is applied the stresses are reduced by the amount of the pre-stress. Because each member of such a truss is subjected to compression, the most damaging stress, either as a part of the pre-stress or under application of the working load, each member of the truss must be designed and sized for the most damaging compressive stress. Moreover, in conventional trusses, the working member is supported by a structure which also resists efforts to adjust the camber of the working member; any effort to adjust the camber of a working member would require deflection of the entire stiffness of the truss.

In the subject invention, by contrast, the working member, the top chord member, may be slightly prestressed by camber adjustment and is the only member, with the exception of the king posts, subject to compression. The other members forming the truss act in unison to resist a load acting on the working member, but act independently when adjusting the camber of the working member. The other members, therefore, only experience slight increases in stress during cambering of the working member. Moreover, the stress is tensile, not compression. The structure of the invention permits camber adjustment of the upper chord member against the stiffness of just the upper chord member since the other supporting members do not resist camber adjustment. Because only the upper chord member and king post are subjected to compression, the remaining members do not have to be sized to accommodate such forces. These benefits and others are achieved through use of the invention as described in the specification as follows. The objects and advantages of the invention may be realized and attained by means of the instrumentalities and combinations as particularly pointed out in the appended claims.

SUMMARY OF THE INVENTION

To achieve the benefits of the invention and in accordance with its purpose, as embodied and broadly described herein, the adjustable camber truss comprises an upper chord member having opposed ends and being disposed to receive a load acting in one direction; a major support structure fixed to and subtending substantially the entire length of the upper chord member, the major support structure comprising a major king post fixed to the upper chord member at a post position proximate the midpoint between the opposed ends and extending therefrom in the one direction to a distal end, and a pair of major tension members, each major tension member having a first end fixed to the upper chord member proximate a respective one of the opposed ends thereof and an axially opposed second end connected to the distal end of the major king post; and means for selectively adjusting the camber of the upper chord member.

In a preferred embodiment, the adjustable camber truss comprises a plurality of minor support structures, each being fixed to and subtending a portion of the length of the upper chord member and being structurally independent of other support structures and comprising a minor king post fixed to the upper chord member at a post position between the midpoint and a respective one of the opposed ends and extending therefrom in the one direction to a distal end, and a pair of minor tension members, each minor tension member having a first end fixed to the upper chord member proximate one of the opposed ends and post positions and having an axially opposed second end connected to the distal end of a minor king post and each minor support structure includes means for selectively adjusting the camber of the portion subtended by it.

The preferred means for adjusting the camber of the upper chord member comprises a threaded portion on each major and minor tension member proximate the second end thereof, a pair of hollow tubes fixed to the distal end of each king post, each tube slidably receiving a respective one of the tension members and the second end of each tension member projecting from one end of a respective tube, and a nut threadably received on the threaded portion of each tension member and being disposed to selectively, coaxially engage the one end of the respective tube.

The invention further comprises a method of adjusting the camber of an upper chord member of a truss, the upper chord having opposed ends and being disposed to receive a load acting in one direction, the method comprising the steps of structurally supporting the upper chord member with a major support structure comprising a major king post fixed to the upper chord member at a post position proximate the midpoint thereof and extending therefrom in the one direction to a distal end, and a pair of major tension members each having a first end fixed to the upper chord member proximate a respective end thereof and an opposed second end adjustably connected to the distal end of the major king post; and selectively adjusting the connection of each major tension member with the distal end of the major king post to move the king post and the midpoint of the upper chord member in a direction opposite to the one direction.

The invention consists of novel parts, constructions, arrangements, combinations and improvements shown and described.

BRIEF DESCRIPTION OF THE DRAWINGS

The accompanying drawings, which are incorporated in and constitute a part of this specification, illustrate embodiments of the invention and, together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

In accordance with the invention, the adjustable camber truss comprises an upper chord member having opposed ends and being disposed to receive a load acting in one direction. As embodied and depicted in FIG. 1, the adjustable camber truss 10 comprises upper chord member 12 having opposed ends 14, 16 and being disposed to receive a load acting in a one direction represented by arrows 18.

The truss, in accordance with the invention, further comprises a major support structure fixed to and subtending substantially the entire length of the upper chord member. The major support structure comprises a major king post fixed to the upper chord member at a major post position proximate the midpoint between the opposed ends and extending therefrom in the one direction to a distal end; and a pair of major tension members, each major tension member having a first end fixed to the upper chord member proximate a respective one of the opposed ends thereof and an axially opposed second end connected to the distal end of the major king post.

Figure 1:
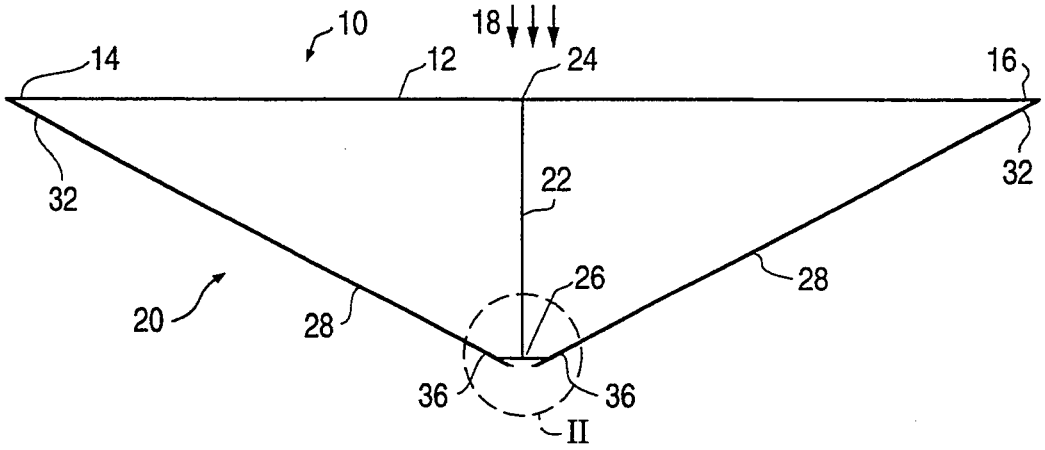
FIG. 1 is a side view of an adjustable camber truss in accordance with the invention.

As depicted in FIG. 1, major support structure 20 is fixed to and subtends substantially the entire length of upper chord member 12. Major support structure 20 comprises a major king post 22 fixed to the upper chord member 12 at major post position 24 proximate the midpoint between opposed ends 14, 16. The major king post 22 extends from upper chord member 12 in the one direction 18 to a distal end 26. Major support structure 20 further comprises a pair of major tension members 28. Each major tension member 28 has a first end 32 fixed to upper chord member 12 proximate a respective opposed end 14, 16. Each major tension member 28 also has a second end 36 opposed to first end 32 and connected to distal end 26 of major king post 22.

Figure 2:
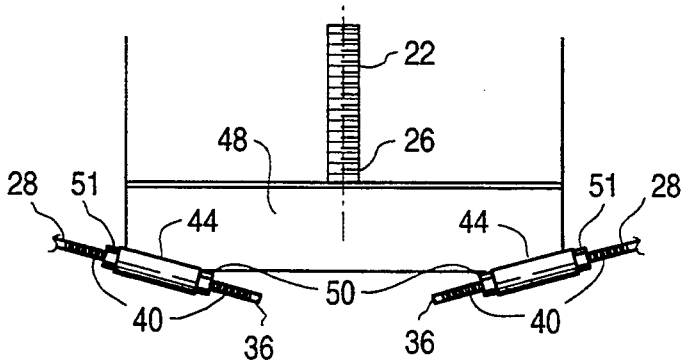
FIG. 2 is an enlarged view of the portion of the adjustable camber truss of FIG. 1 encompassed by the circle II.

In accordance with the invention, the adjustable camber truss further comprises means for selectively adjusting the camber of the upper chord member. In a preferred embodiment, the adjusting means comprises a threaded portion 40 on each tension member proximate the respective second end 36 thereof, and a pair of hollow tubes 44 fixed to the distal end 26 of major king post 22. As depicted in FIG. 2, a plate 48 is welded to distal end 26 of king post 22 and disposed to extend parallel to upper chord member 12 and in the plane of adjust-able camber truss 10. Tubes 44 are welded to plate 48 in position to slidably receive second ends 36 of major tension members 28. As depicted in FIG. 2, the second ends 36 project through one end of respective tubes 44. The threaded portion 40 on second ends 36 extend to receive nuts 50 which are disposed to selectively coaxially engage the one end of tubes 44. Tubes 44 are so spaced on plate 48 to permit access to nuts 50 for adjustment. The internal diameter of tubes 44 is slightly larger than the diameter of the portions of members 28 disposed therein.

In an alternative embodiment, second nuts 51 may be disposed on threaded portion 40 for selective engagement with the other end of tubes 44. The second nuts would be used to lock tension members 28 in place once required adjustments have been made with nuts 50.

Figure 3:
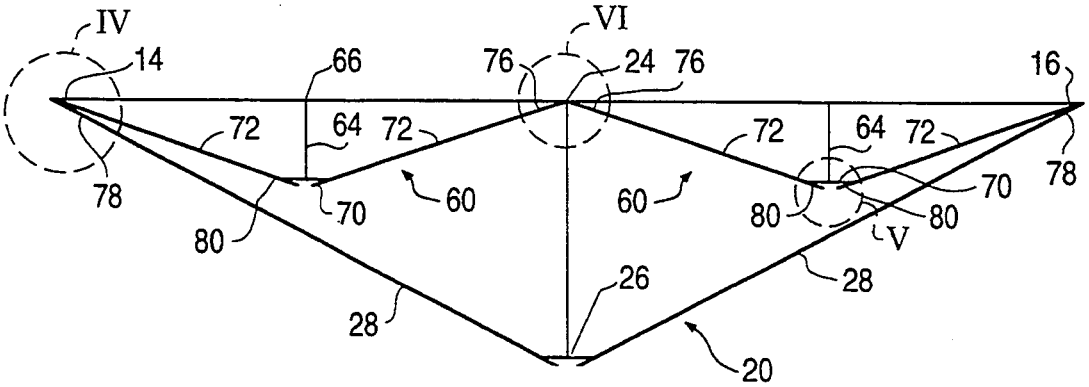
FIG. 3 is a side-view of a second embodiment of an adjustable camber truss in accordance with the invention.
Figure 7:
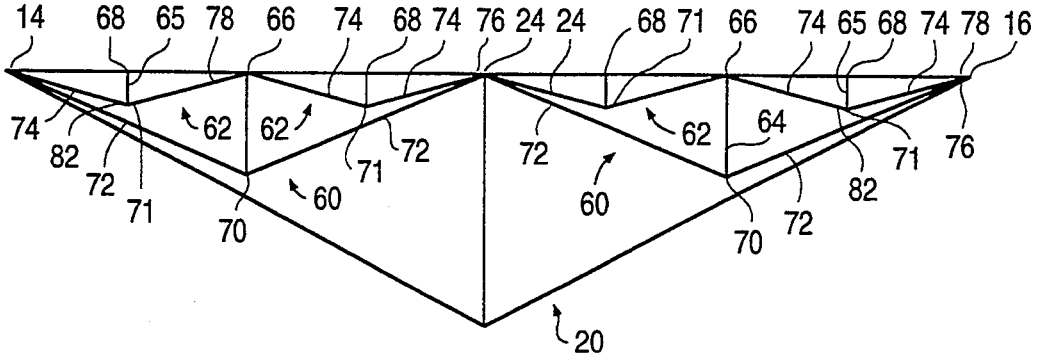
FIG. 7 is a side view of another embodiment of the truss in accordance with the invention.

In order to avoid more costly structural materials, any truss in accordance with the invention having a transverse length greater than 15 feet should include minor support structures. As depicted in FIGS. 3 and 7, the truss of the invention may include two or more minor support structures 60, 62. A truss including two minor support structures 60 (FIG. 3) may have a practical span of 30 feet without increasing material strength over that used for the truss of FIG. 1. Six minor support structures 60, 62 (FIG. 7) would increase the practical span of the truss of FIG. 1 to 60 feet. Such minor support structures provide resistance to greater loads acting in the one direction 18 and also provide means for adjusting the camber of the upper chord member over less than its entire length.

The preferred embodiment of the truss, therefore, also includes a plurality of minor support structures 60, 62 (FIGS. 3 and 7) fixed to and subtending a portion of the length of upper chord member 12. Each minor support structure 60, 62 is independent of other support structures, including major support structure 20. Thus, as may be seen in FIGS. 3 and 7, minor support structures 60, 62 are fixed to and depend from the upper chord member 12 but are not connected to any of the other support structures. In this way, the support structures do not contribute to the stiffness of the upper chord member and therefore do not resist or work in opposition to camber adjustments of the upper chord member. However, when a load is applied in direction 18 all support structures cooperate to resist the load. For camber adjustment the upper chord member effectively is a free span with no resisting subtrusses, and any adjustments to camber are acting against gravity (or load) and the singular stiffness of the upper chord member.

In the preferred embodiment, each minor support structure comprises a minor king post 64, 65 fixed to upper chord member 12 at a respective minor post position 66, 68 between major post position 24 and a respective one of opposed ends 14, 16.

In the embodiment of FIG. 3, minor post positions 66 are each proximate the midpoint between major post position 24 and the respective opposed end 14, 16. The embodiment of FIG. 7 adds four additional minor post positions 68 each proximate a midpoint between adjacent post positions or a post position and an opposed end. Each minor king post 64, 65 extends from its respective minor post position 66, 68 in the one direction 18 to a respective distal end 70, 71.

Each minor support structure 60, 62 further includes a pair of minor tension members 72, 74, each having a first end 76, 78 fixed to upper chord member 12 proximate one of opposed ends 14, 16 or post positions 24, 66, 68, and having opposed second ends 80, 82 connected to a respective distal end 70, 71 of a minor king post 64, 65.

Figure 5:
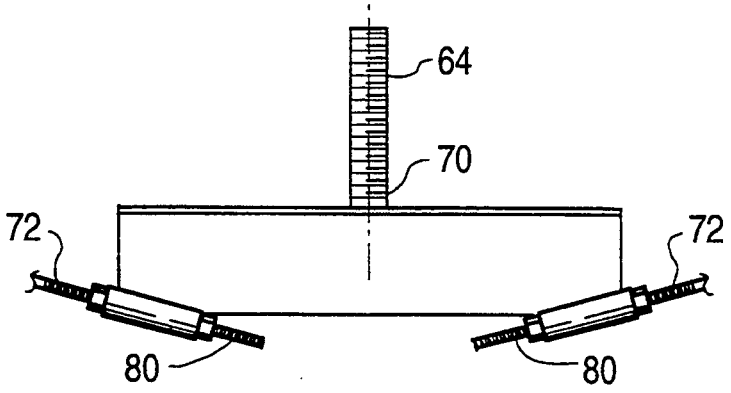
FIG. 5 is an enlarged view of a portion of the truss of FIG. 3 encompassed by circle V.

Minor support structures 60, 62 are essentially identical to the major support structure 20 except they subtend a smaller portion of the upper chord member 12. Each minor support structure includes an adjusting means whereby the second ends 80, 82 of minor tension members 60, 62 are adjustably connected to distal ends 70, 71 of respective minor king posts 64, 65. The structure of adjustably connecting the minor tension members to the distal ends of the minor king posts are depicted in FIG. 5 and are identical to that described above with respect to the major support structure.

Figure 4:
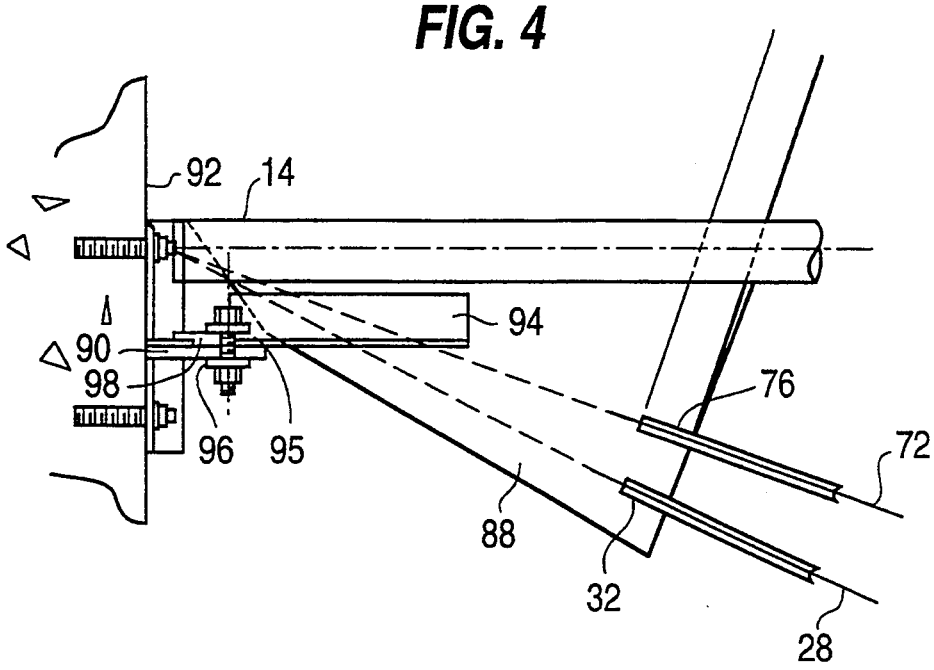
FIG. 4 is an enlarged view of an end of the upper chord member of the truss in FIG. 3 encompassed in circle IV.
Figure 6:
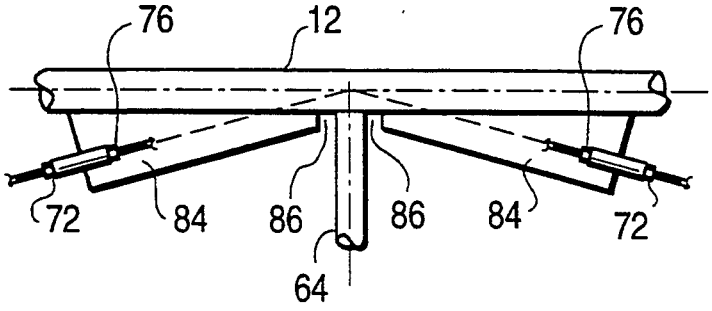
FIG. 6 is an enlarged view of the portion of the truss of FIG. 3 as in circle VI.

Minor tension members 72, 74 are attached at first ends 76, 78 to upper chord member 12 depicted in FIGS. 4 and 6. First ends 76, 78 of minor tension members 72, 74 disposed adjacent a post position are welded to plates 84 which are welded to upper chord member 12 on either side of and in spaced relation to king posts 22, 64. Spaces 86 are included to minimize the stiffening effect plate 84 would have on upper chord member 12, particularly if plate 84 were attached to the adjacent king post. Preferably, the length of plate 84 should be at the minimum necessary to permit attachment of tension members 72, 74 since plate 84 itself adds some stiffening effect to member 12. Stiffening of member 12 should be minimized in order to minimize the force needed to adjust its camber.

First ends 32, 76 of tension members 28, 72 are fixed to respective opposed ends 14, 16 of upper chord member 12 as depicted in FIG. 4. The first ends are separately welded to end plate 88 which is welded to upper chord member 12 proximate respective first ends 14, 16. Again, the length of end plate 88 should be minimized to preclude undue stiffening the upper chord member 12. The stiffening effect of plates 88, however, will not have as significant an effect on camber adjustment as that of plates 84 since plates 88 are adjacent the opposed ends where little deflection is sought.

While there may be relative little deflection of chord member 12 at its opposed ends 14, 16, camber adjustment of the upper chord member will require freedom of movement at least one end of the upper chord member. Camber adjustment of member 12 would be resisted if at least one opposed end 14, 16 were not free to move within certain limits. A mounting structure for a truss in accordance with the invention is depicted in FIG. 4. While this structure may be used on both ends of upper chord member 12, the moveable mounting is only necessary for one end.

As depicted in FIG. 4, flange 90 is fixed to and projects wall 92. Angle 94 is fixed to end plate 88 forming a surface disposed to rest on flange 90. To reduce friction, a strip of friction reducing material 95 may be placed between angle 94 and flange 90. Angle 94 is connected to flange 90 by bolt 96 disposed in slot 98 in angle 94. The slot limits for slidable movement of end 14 of member 12 relative to wall 92. The same movable support for member 12 may be achieved by other methods, such as disposing either end 14, 16 in a groove in the wall, the dimensions of the grooves limiting the motion of the members, or by attaching either end to a roller which rests on a column or wall or other supporting structure, and permits limited rolling movement.

Figure 8A:
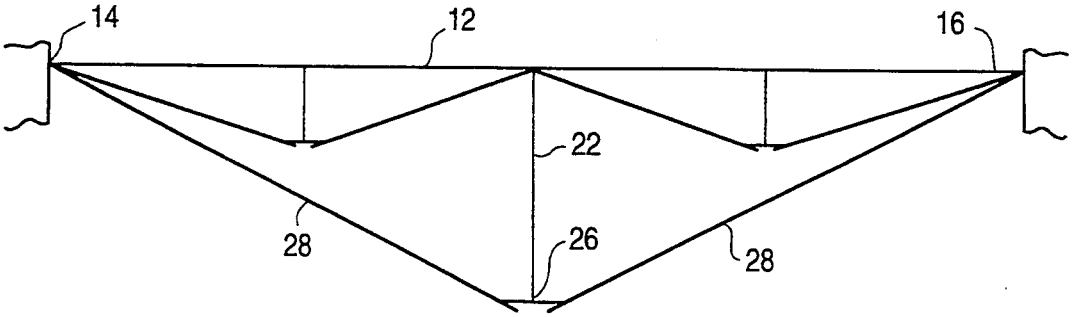
FIGS. 8*a* and 8*b* depict the effect of pre-cambering the upper chord member in the embodiment of FIG. 3.
Figure 8B:
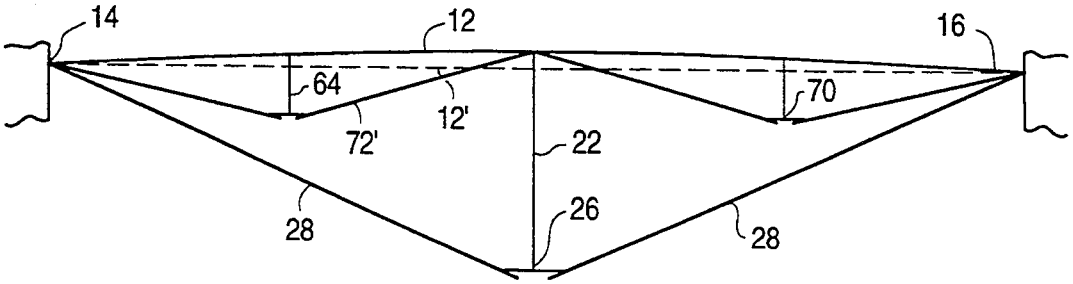

The truss of the invention may be adjusted in loaded and unloaded conditions. The camber of the upper chord member may be adjusted by tightening nut 50 on the threaded ends of tension members 28 against the one end of respective tubes 44. This has the effect of deflecting upper chord member 12 from the unloaded, neutral position depicted in FIG. 8*a*. The scope of such deflection (exaggerated for clarity) is depicted in FIG. 8*b* by dashed line 12′ which represents the neutral position.

Such camber adjustment also may be accomplished after a nonrigid load has been applied to the upper chord member 12. The camber would have to be adjusted without the load where the upper chord member was to support a rigid load.

Figure 9A:
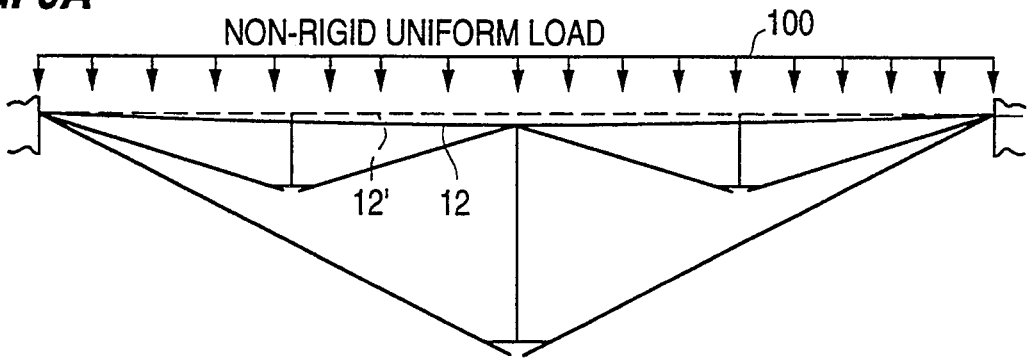
FIGS. 9*a*, 9*b*, 9*c* and 9*d* depict the process of post cambering the embodiment of the truss in FIG. 3.
Figure 9B:
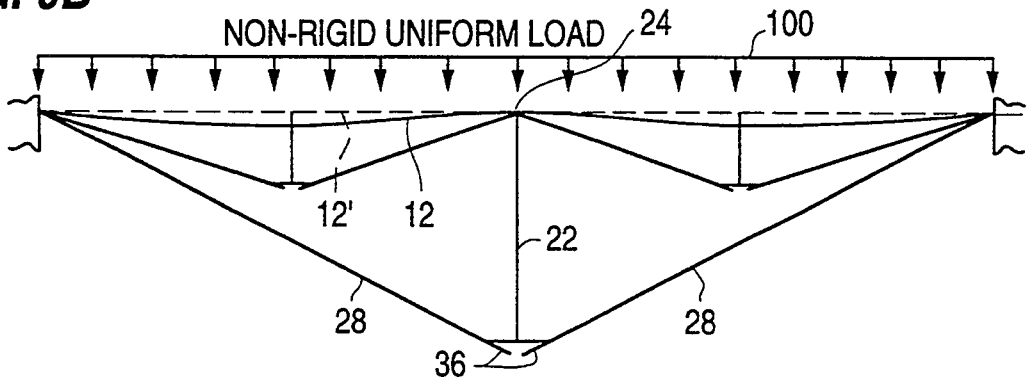
Figure 9C:
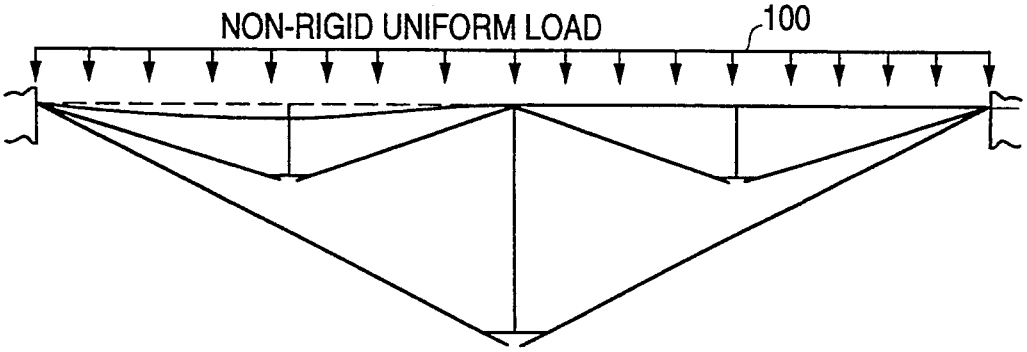
Figure 9D:
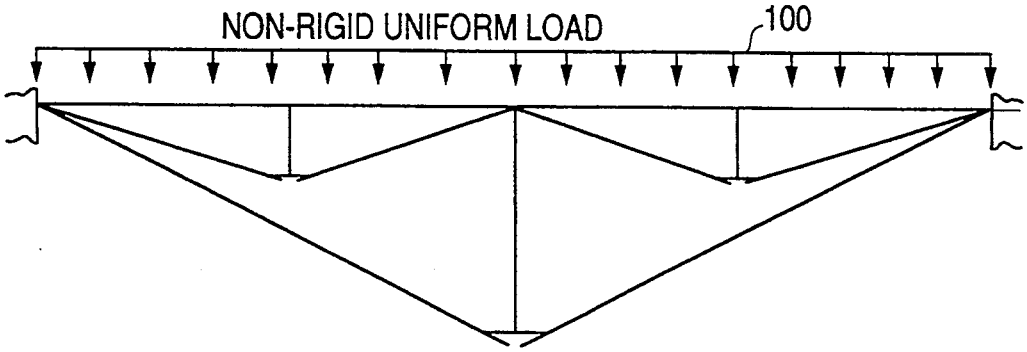

As depicted in FIG. 9*a*, nonrigid uniform load 100 is applied to upper chord member 12 deflecting it in the one direction 18 from the neutral position 12′ to the location depicted in FIG. 9*a*. By adjusting nuts 50 on second ends 36 of tension members 28, the area of upper chord member 12 proximate major post position 24 is deflected in opposition to load 100 as depicted in FIG. 9*b*. Such deflection has the effect of reducing the stress on upper chord member 12. Where the span of truss 10 does not require minor support structures, that is the only adjustment needed. Where, however, minor support structures are included in the truss, they also may be adjusted to adjust the camber of upper chord member 12. Preferably, major support structure 20 is adjusted first followed by the minor support structures. These steps are depicted sequentially in FIGS. 9*a* through 9*d*. A truss as depicted in FIG. 7 would be adjusted by selectively tightening or loosening the nuts on the larger support structures before the smaller.

Where small deflections are needed, the entire amount my be obtained by a single adjustment to each support structure. Where a large deflection is required, sequential, incremental adjustments are made to achieve the required deflection in steps.

A preferred application of trusses in accordance with the invention is support for biological, filter or other plastic media modules in water and waste water treatment plants. The trusses, however, have application wherever a load acting in one direction requires support across a span. For example, the trusses could be used as support for overhead cranes or as pipe support bridges. In the latter application, the trusses would first be adjusted against the dead weight of the pipes and then the camber would be adjusted to compensate for the fluid load in the pipes. If the pipes were flexible, the camber could be adjusted after installation and during use.

The trusses of the invention may be assembled in box form where two or more trusses are disposed in transversely adjacent relation. The trusses may be connected at the respective opposed ends by the structure on which the trusses are mounted. Further connections may be made between the trusses at respective post positions. For stability, a connection between adjacent trusses may also be at respective distal ends of major king posts. Preferably, such connections at distal ends and post positions are by rigid structural elements.

A box structure as discussed above could be use as support for a variety of applications. A road could be supported; such would be a rigid load requiring camber adjustment before application of the load. The camber of adjacent upper chord members in such a box construction may be separately adjusted to provide a desired pitch to the road surface for drainage.

These box trusses are lightweight in comparison to their strength and could be used for applications such as temporary bridges that could be shipped in a folded condition or broken down for field assembly. Another use would be for scaffolding platforms.

The invention provides an adjustable truss which may be used in many applications of load support. It will be apparent to those skilled in the art that various modifications and variations may be made in the trusses of the invention without departing from the scope or spirit of the invention.

What is claimed is:

1. An adjustable camber truss comprising:

an upper chord member having opposed ends and being disposed to receive a load acting in one direction;

a major support structure fixed to and subtending substantially the entire length of the upper chord member, the major support structure comprising:

a major king post fixed to the upper chord member at a major post position proximate the midpoint between the opposed ends and extending therefrom in the one direction to a distal end; and a pair of major tension members, each major tension member having a first end fixed to the upper chord member proximate a respective one of the opposed ends thereof and an axially opposed second end; and a coupling between the second end of each major tension member and the distal end of the major king post, each coupling being selectively adjustable to axially move the king post and thereby selectively adjust the camber of the upper chord member.

2. The truss of claim 1 also including a plurality of minor support structures fixed to and subtending a portion of the length of the upper chord member, each minor support structure being structurally independent of other support structures and comprising:

a minor king post fixed to the upper chord member at a minor post position proximate the midpoint of the subtended portion of the upper chord member and extending therefrom in the one direction to a distal end;

a pair of minor tension members, each minor tension member having a first end fixed to the upper chord member proximate a respective one of the opposed ends of the subtended portion of the upper chord member and having an axially opposed second end; and a coupling between the second end of each minor tension member and the distal end of the minor king post, each coupling being selectively adjustable to axially move the minor king post and thereby selectively adjust the camber of the respective subtended portion of the upper chord member.

3. The truss of claim 1 or 2 wherein the coupling comprises a threaded portion on each tension member proximate the second end thereof, a pair of hollow tubes fixed to the distal end of each king post, each tube slidably receiving a respective one of the tension members and the second end of each tension member projecting from one end of a respective tube, and a nut threadably received on the threaded portion of each tension member and being disposed to selectively, coaxially engage the one end of the respective tube.

4. The truss of claim 3 wherein the adjusting means also includes a second nut threadably received on the threaded portion of each tension member and disposed to selectively, coaxially engage the other end of the respective tube.

5. The truss of claim 2 including two minor support structures, one disposed on each side of the major king post and subtending the respective portion of the upper chord member between a respective end of the upper chord member and the major post position.

6. An adjustable camber truss comprising:

an upper chord member having opposed ends and being disposed to receive a load acting in one direction;

a plurality of independent support structures each being fixed to and subtending a part of the upper chord member, each support structure comprising:

a king post fixed to the upper chord member at a post position proximate the mid-point of the subtended part of the upper chord member and extending therefrom in the one direction to a distal end; and a pair of tension members, each tension member having a first end fixed to the upper chord member proximate a respective one end of the subtended part of the upper chord member and an opposed second end connected to the distal end of the respective king post; and an adjustable connector in each tension member disposed between the first end thereof and the distal end of the respective king post, each connector being adapted on selective adjustment to move axially the respective king post thereby adjusting the camber of the subtended part of the upper chord member.

7. A method of adjusting the camber of an upper chord member of a truss, the upper chord having opposed ends and being disposed to receive a load acting in one direction, the method comprising the steps of:

structurally supporting the upper chord member with a major support structure comprising a major king post fixed to the upper chord member at a major post position proximate the midpoint thereof and extending therefrom in the one direction to a distal end and a pair of major tension members each having a first end fixed to the upper chord men, bet proximate a respective end thereof and an opposed second end adjustably connected to the distal end of the major king post; and selectively adjusting the connection of each major tension member with the distal end of the major king post to move the king post and the midpoint of the upper chord member in a direction opposite to the one direction.

8. The method of claim 7 also including the steps of:

structurally supporting portions of the length of the upper chord member with a plurality of minor support structures subtending those portions, each minor support structure comprising a minor king post fixed to the upper chord member at a minor post position between the major post position and a respective one of the opposed ends and extending therefrom in the one direction to a distal end and a pair of minor tension members, each minor tension member having a first end fixed to the upper chord member proximate one of the opposed ends and post positions and having an opposed second end adjustably connected to the distal end of the minor king post, and selectively adjusting the connection of each minor tension member with the distal end of the respective minor king post to move in a direction opposite to the one direction the minor king post and the portion of the upper chord member proximate the post position of the minor king post.

* * * * *

UNITED STATES PATENT AND TRADEMARK OFFICE

CERTIFICATE OF CORRECTION

PATENT NO. : 5,337,531
DATED : August 16, 1994
INVENTOR(S) : Sidney L. Thompson

It is certified that error appears in the above-indentified patent and that said Letters Patent is hereby corrected as shown below:

Claim 7, column 8, line 38, change "men, bet" to --member--.

Signed and Sealed this

Twenty-fifth Day of October, 1994

*Attest:*

*Attesting Officer*

BRUCE LEHMAN

*Commissioner of Patents and Trademarks*